US005685047A

United States Patent [19]

Demuth et al.

[11] Patent Number: 5,685,047

[45] **Date of Patent: *Nov. 11, 1997**

[54] APPARATUS FOR ATTACHING WORKING ELEMENTS

[75] Inventors: Robert Demuth, Nurendorf; Beat Naef, Jona; Werner Hirschle; Lars Weisigk, both of Winterthur, all of Switzerland

[73] Assignee: Maschinenfabrik Rieter AG, Winterthur, Switzerland

[ * ] Notice: The term of this patent shall not extend beyond the expiration date of Pat. No. 5,471,710.

[21] Appl. No.: 538,975

[22] Filed: Oct. 5, 1995

Related U.S. Application Data

[63] Continuation-in-part of Ser. No. 219,383, Mar. 29, 1994, Pat. No. 5,471,710.

[30] Foreign Application Priority Data

Mar. 30, 1993 [CH] Switzerland ..... 979/93-4

[51] Int. Cl.[6] ..... D01G 15/28

[52] U.S. Cl. ..... 19/113; 19/98; 19/114

[58] Field of Search ..... 19/113, 98, 114, 19/104

[56] References Cited

U.S. PATENT DOCUMENTS

| | | | |
|---|---|---|---|
| 237,079 | 1/1881 | Gould | 19/104 |
| 339,097 | 3/1886 | Harmon | 19/104 |
| 431,685 | 7/1890 | Canning | 19/104 |
| 4,286,357 | 9/1981 | Harrison, Sr. | 19/104 X |
| 4,947,522 | 8/1990 | Staehli | 19/113 X |
| 5,005,260 | 4/1991 | Oda | 19/113 X |
| 5,090,092 | 2/1992 | Dempsey | 19/113 |
| 5,471,710 | 12/1995 | Demuth et al. | 19/113 |

FOREIGN PATENT DOCUMENTS

| | | |
|---|---|---|
| 0252018 | 1/1988 | European Pat. Off. . |
| 0476407 | 3/1992 | European Pat. Off. . |
| 579170 | 10/1924 | France . |
| 652484 | 3/1929 | France . |
| 609287 | 1/1935 | Germany . |
| 358722 | 1/1962 | Switzerland . |
| 1582405 | 1/1981 | United Kingdom . |

*Primary Examiner*—John J. Calvert
*Attorney, Agent, or Firm*—Greenblum & Bernstein, P.L.C.

[57] ABSTRACT

An apparatus for precisely orienting working elements, such as carding elements, to a rotating fiber-opening roller, such as a licker-in, with regard to both distancing and centering without necessitating complex adjustment mechanisms. The working element is precisely positioned by virtue of respective abutting engagement surfaces of the axle boxes or roller retainers and the carrier of the working elements.

31 Claims, 10 Drawing Sheets

APPARATUS FOR ATTACHING WORKING ELEMENTS

CROSS-REFERENCE TO RELATED APPLICATIONS

This application is a continuation-in-part of application Ser. No. 08/219,383, filed on Mar. 29, 1994, now U.S. Pat. No. 5,374,710, the disclosure of which is hereby incorporated by reference in its entirety.

Further, this application claims the priority of Swiss Application No. 00 979/93-4, filed Mar. 30, 1993, the disclosure of which is hereby incorporated by reference in its entirety.

BACKGROUND OF THE INVENTION

1. Field of the Invention

This invention pertains to an apparatus for attaching working elements, such as a fixed carding element, to a rotating, fiber-opening roller of a preparatory machine in a spinning mill. Further, the invention pertains to the combination of the fiber-opening roller, working element and apparatus for positioning the working element with respect to the roller.

2. Discussion of the Background and Relevant Information

In the field of spinning mill preparatory machines, particularly in carding machines, it is known to attach working elements, such as separation knives, fixed carding elements, and the like, directly on the machine frame and then to set the working elements to the correct radial and/or pivot distance, relative to the rotating roller, by means of setting means such as eccentrically held discs, slots, spacers, or the like.

These settings require a considerable amount of effort and have to be carried out regularly in several partial steps, as the adjustment of the setting means and a subsequent fixation, via a screw, again causes a slight displacement of the setting, i.e., the distance, to be made. For such settings it is necessary to precisely adhere to the required tolerance ranges, which are constantly becoming increasingly narrower, by means of sheet calibers, screw pitch gages and the like.

Previously, it was always the custom that fiber-opening rollers were held directly in a machine frame and that the pertinent working elements, such as separation knives and fixedly arranged carding elements, were also attached to the machine frame. Due to the production tolerances it was thus necessary to set the required working distances by means of setting means such as spacers, slots, screws, etc. only during the installations thereof. However, following the production of fiber-opening rollers, such as pin rollers, clothing rollers provided with saw teeth, or needle rollers, with ever-increasing precision, the outer circumferences have become nearly ideally cylindrical and the diametrical tolerances are kept minimal.

This trend or realization caused the inventors to seek new means to allow the working elements to be arranged more precisely with respect to the roller. An accurately fitting attachment of the working element on the axle box or bearing retainer of the rotating roller gives, in addition to the advantage that less components are required, among other things, the added enormous advantage that a textile machine can be produced with less effort related to work involved, i.e., with considerably less adjustment work.

FIGS. 19 and 20 schematically illustrate a prior art arrangement improved upon by the present invention.

Shown therein are angular end caps 6' which are fixed to axle retainers 4'. The working elements are adjustable relative to end caps 6', as best seen in FIG. 19, thus permitting a radial adjustment of working element 7' relative to fiber-opening roller 1', this being depicted by arrows 56 in FIG. 19. As shown in FIGS. 19 and 20, each bearing retainer is made in two parts, i.e., a top section 60 and a bottom section 61. The two sections have mating fixing flanges **62*a*, 62*b*** which are secured together.

One of the bearing retainer sections 60, 61 carries the end cap and the other can be lifted off, after loosening of a suitable fastening means (not shown) in order to enable removal of the roller 1' while leaving the working element 7' in place in the machine. In the prior art, this removal of the roller gave access to the carrier for the working element and thus enabled adjustment of the settings. However, since it is not easy to adjust the settings while the roller 1' is absent, it is necessary to simulate the roller by means of an additional element.

To permit the pivotal adjustment of working element 7' relative to roller 1', adjustment also had to be made relative to a pivot point 57 (FIG. 20) in working element 7' and, furthermore, there was a provision for making a circumferential or angular adjustment between working element 7' and roller 1' to permit shifting of the former between points 58 and 59 (FIG. 20). These figures indicate that the system had to allow for the adjustment of elements 8', 9' in the radial, pivotal and circumferential direction relative to roller 1'.

Needless to say, setting the prior art system is a very onerous task which is not helped by the fact that this module is not easily accessible in the complete machine, particularly since the working element is located below the roller. It should not be hard to appreciate how difficult and tedious it can be to obtain the correct settings, bearing in mind that the width of the card (about one meter), corresponds to the length of the working element. One must keep in mind that the accuracy of such an adjustment is on the order of +/−0.005 mm (about 0.002 inches). The inventors' own personal experiences are that it is not unusual that such an adjustment can take at least an 8 hour day and require a setting device (in place of the fiber-opening roller) for adjustment purposes, which of course, in turn, requires initial removal of the fiber-opening roller, so as to permit installation and subsequent removal of the setting device. Further, reinstallation of the fiber-opening roller is then necessary, which reinstallation procedure is now obsolete by virtue of the evolution represented by the present invention.

Another example of the prior art is represented by U.S. Pat. No. 4,286,357. As with the previously described prior art installation, the apparatus of this U.S. patent requires careful and tedious setting of a center threaded shank that forms a pivotal member for the working element and a pair of opposite threaded shanks for setting the orientation of the working element relative to the fiber roller.

SUMMARY OF THE INVENTION

It is an the object of this invention to provide an arrangement for precisely positioning a working element with respect to a fiber roller, within a narrow tolerance range, in a more simple manner than in the previously described arrangements.

This object is achieved via an apparatus for attaching a working element to a rotating fiber-opening roller, the roller being rotatably journalled in spaced axle or roller retainers, wherein the working element is attached on the axle retainers via respective spacers or end caps, with the end caps at least partially encompassing the axle retainers.

The end caps are connected either to the axle retainers or to the working element, with each of the end caps preferably being provided with a planar or arcuate surface in the area of the working elements or the axle retainers.

In one embodiment of the present invention, each of the end caps is at least partially prismatically shaped.

In another embodiment of the present invention, each of the end caps is provided with a recess, with the recess including means for guiding, which preferably consists of angular grooves.

In a further embodiment of the invention, each of the end caps is of a unitary or one-piece construction either with the axle retainer or with the working element.

The apparatus of the invention, in one form, includes a fiber-opening roller extending along a longitudinal axis, a plurality of roller retainers for supporting the roller at spaced locations for rotation around the longitudinal axis of the roller and at least one abutting engagement surface of each of the roller retainers fixed with respect to each respective roller retainer. The apparatus furthermore includes a working element and at least one abutting engagement surface thereof fixed with respect to the working element, a positioning arrangement for setting the working element at a predeterminate fixed position with respect to the roller against radial and pivotal adjustability of the working element with respect to the roller, by affixation of a first engagement surface with a second engagement surface. The first engagement surface includes either one of the abutting engagement surfaces of the working element or the abutting engagement surface of a respective roller retainer and the second engagement surface including an abutting engagement surface fixed with respect to the other of the working element and a respective roller retainer.

The apparatus according to the invention can also be defined as an apparatus that includes a fiber-opening roller extending along a longitudinal axis, a plurality of roller retainers for supporting the roller at spaced locations for rotation around the longitudinal axis of the roller, a working element, and a positioning arrangement for setting the working element at a predeterminate position with respect to the roller. The positioning arrangement includes a plurality of spacers for positioning the working element a predeterminate distance from the exterior periphery of the roller. Lastly, the plurality of spacers are longitudinally spaced apart and each of the spacers is located between a respective roller retainer and a respective portion of the working element for ensuring precise radial and pivotal orientation of the working element relative to the fiber-opening roller.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
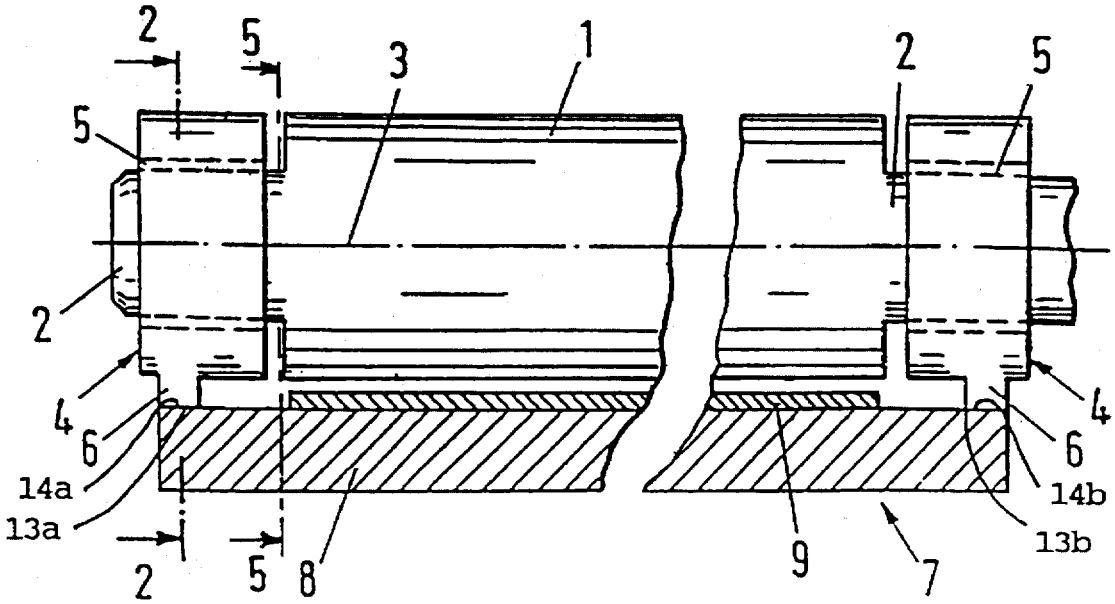
FIG. 1 is a schematic partial side view of a fiber-opening roller including a cross section through a fixed carding element.

FIG. 1 shows a fiber-opening roller 1, which here preferably takes the form of a licker-in, wherein the needles, tips or saw-tooth clothings thereof are not shown. At spaced locations along the longitudinal axis 3 of the roller 1, the roller is supported via its axles or shafts 2 by means of axle boxes or axle retainers 4, also referred to herein as roller supports or roller retainers. The right portion of shaft 2 is shown with a broken end section, as it is connected with a non-illustrated drive unit of any desired type. A rolling contact bearing 5, shown purely schematically, resides within axle box 4, with rolling contact bearing preferably taking the form of a roller or needle bearing.

Figure 2:
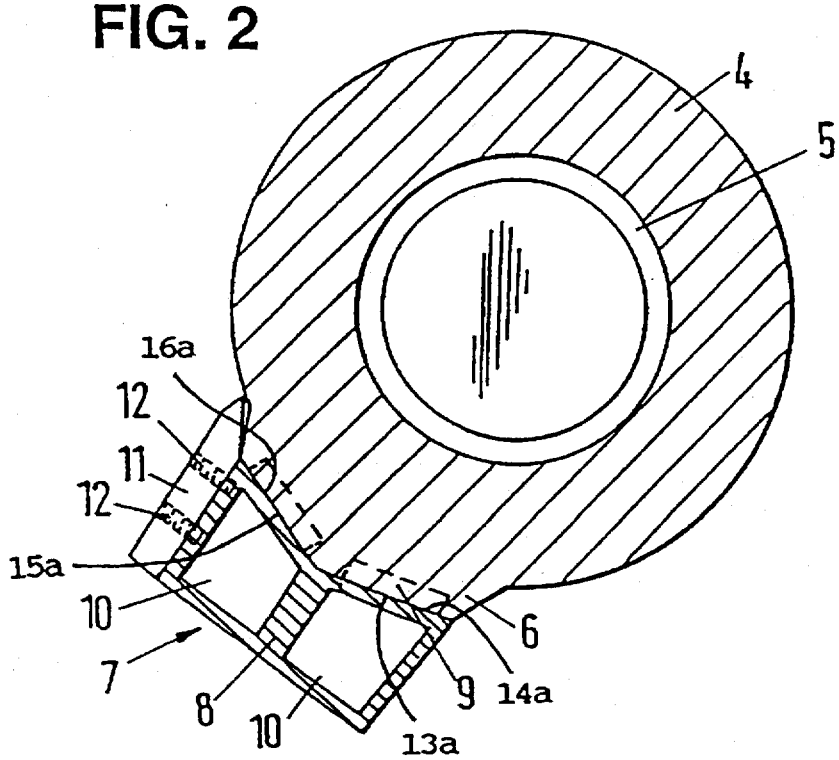
FIG. 2 is a sectional end view, taken along line 2—2 of FIG. 1, through the axle box and the working element, showing the end cap being unitary with the axle box.

In the embodiment of FIGS. 1 and 2, axle boxes 4 include spacers 6, in the form of end caps having a working element 7 attached thereto, which, in this embodiment, takes the form of a fixed carding element. As can be seen in FIG. 1, each of the end caps is positioned between the end surfaces of a respective one of the axle boxes 4 and between the end surfaces of the working element 7. Fixed carding element 7 includes a carrier 8 and one or more combing inserts 9, with carrier 8 being attached to cap 6 by means of non-illustrated screws or other equivalent means, such as weldments, adhesives and other mechanical fastenings, for example.

FIG. 2 shows the same elements as FIG. 1 and utilizes the same reference numerals. As can readily be seen in the drawing, end cap 6 is arranged prismatically in the zone adjacent to carding element 7, i.e., the connecting surfaces or areas of cap 6 abutting with carrier 8 are consistent with or correspond to the surfaces or areas of a prism having a plurality of corners. Carrier 8 includes a drawn aluminum profile having hollow chambers 10 so as to both ensure stability and to allow adequate dissipation of the heat arising during operation. On the left side of carrier 8, as seen in FIG. 2, a separator blade 11 is fixedly attached to the carrier with, for example, two hexagon socket screws 12. Non-illustrated slots in separator blade 11 permit the precise positioning of the blade tip thereof with respect to the saw-tooth clothing of roller 1.

Figure 3:
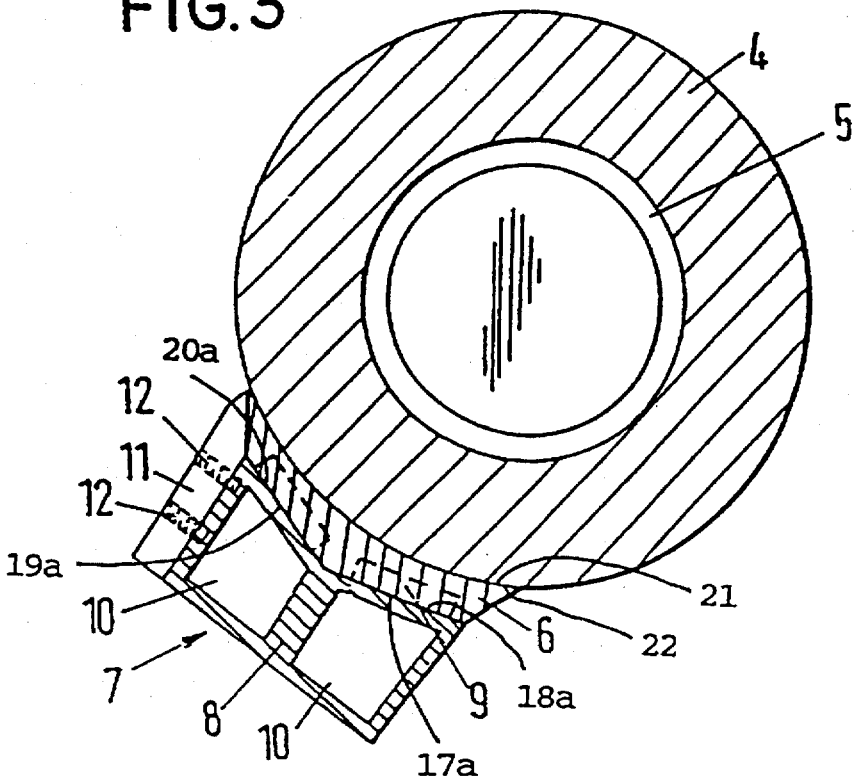
FIG. 3 is a sectional end view, similar to that of FIG. 2, showing the end cap as a separate part, interposed between the axle boxes and the working element.

As shown in FIG. 2, carrier 8 is also, at least in the area adjacent to end cap 6, prismatically arranged, via which the precise positioning of the carrier 8, with respect to end cap 6, occurs automatically. As shown in FIG. 2, end cap 6 is a unitary part of axle box 4, thereby forming an extension of the axle box, which is generally made of cast iron, which spaces the working element from the carding or working element 7 by a predeterminate precise amount. However, as shown in FIG. 3, end cap 6 may alternatively be a separate part which is fixedly attached, such as by screws, to axle box 4. This latter embodiment, however, has the disadvantage that in this manner a less precise control of the positioning of the working elements, with respect to the rollers, is achieved, since the attached connection also adds further tolerances.

By means of abutting engagement surfaces, the apparatus of the invention provides for precise distance positioning and centering positioning or, in other words, radial and peripheral positioning. That is, the working element 7 is thereby precisely radially spaced, or distanced, from the roller 1 and precisely centered with respect to the roller without any adjustability. For example, no adjustment mechanism is provided nor necessary to pivot the working element 7 about a longitudinal axis thereof in its confronting orientation with respect to the roller 1.

In the embodiment of FIGS. 1, 2, and 3, these abutting engagement surfaces comprises surfaces 13*a*, 13*b* of the spacing extensions or end caps 6 which engage respective surfaces 14*a*, 14*b* of the carrier 8 of the working element 7. More specifically, FIG. 2 shows prismatic surfaces 13*a*, 15*a* of the end caps 6 which engage respective abutting engagement surfaces 14*a*, 16*a* of the carrier 8.

The preciseness required, without the need for adjustment, can be achieved in the illustrated embodiment (see FIG. 5) because the engaging surface of the comb inserts or combing elements 9 are situated in precisely the same plane or in a plane precisely parallel thereto as the engaging surface of carrier 8 on axle boxes 4. For such preciseness it is not absolutely necessary that the surfaces of the cap 6 are at least partly prismatically arranged, but recesses could also be provided in carrier 8. These recesses could, for example, be angular grooves or flutes, for which purpose congruent mating elements would be provided on cap 6. The previously described prismatic arrangement, however, is preferred due to the simplicity of its solution. In another embodiment, as shown in FIG. 4, end caps 6 could also be parts or portions of carrier 8 and respective areas could be provided on axle bearing 4 so as to satisfy the previously mentioned requirement of preciseness.

In FIG. 3, the separate end cap 6 includes prismatic engagement surfaces 17*a*, 19*a* which are in abutment with prismatic engagement surfaces 18*a*, 20*a* of the carrier 8 and arcuate engagement surface 21 which is in abutment with arcuate engagement surface 22 of the roller retainer or axle box 4.

Figure 4:
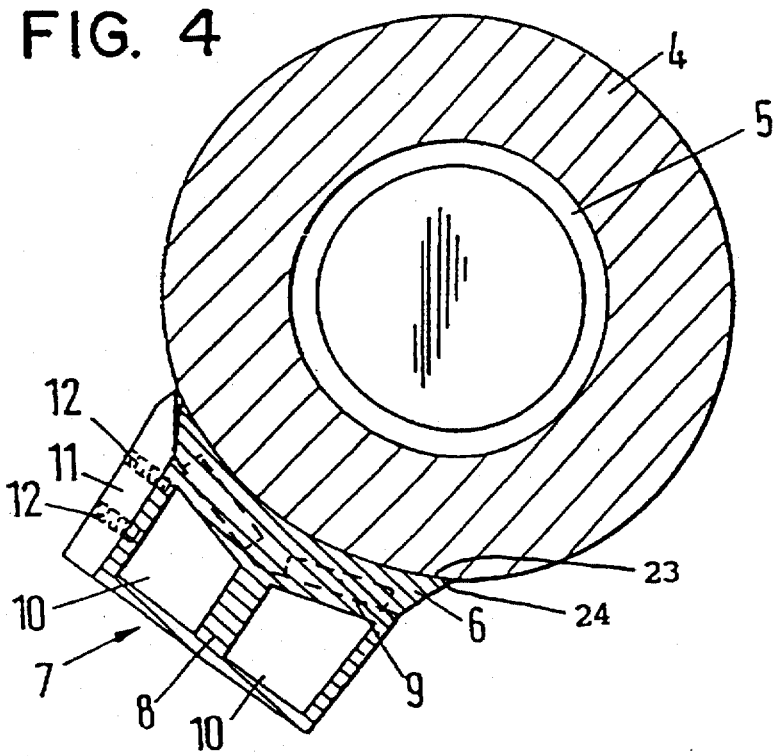
FIG. 4 is a sectional end view, similar to that of FIG. 2, showing the end cap being unitary with the working element.
Figure 5:
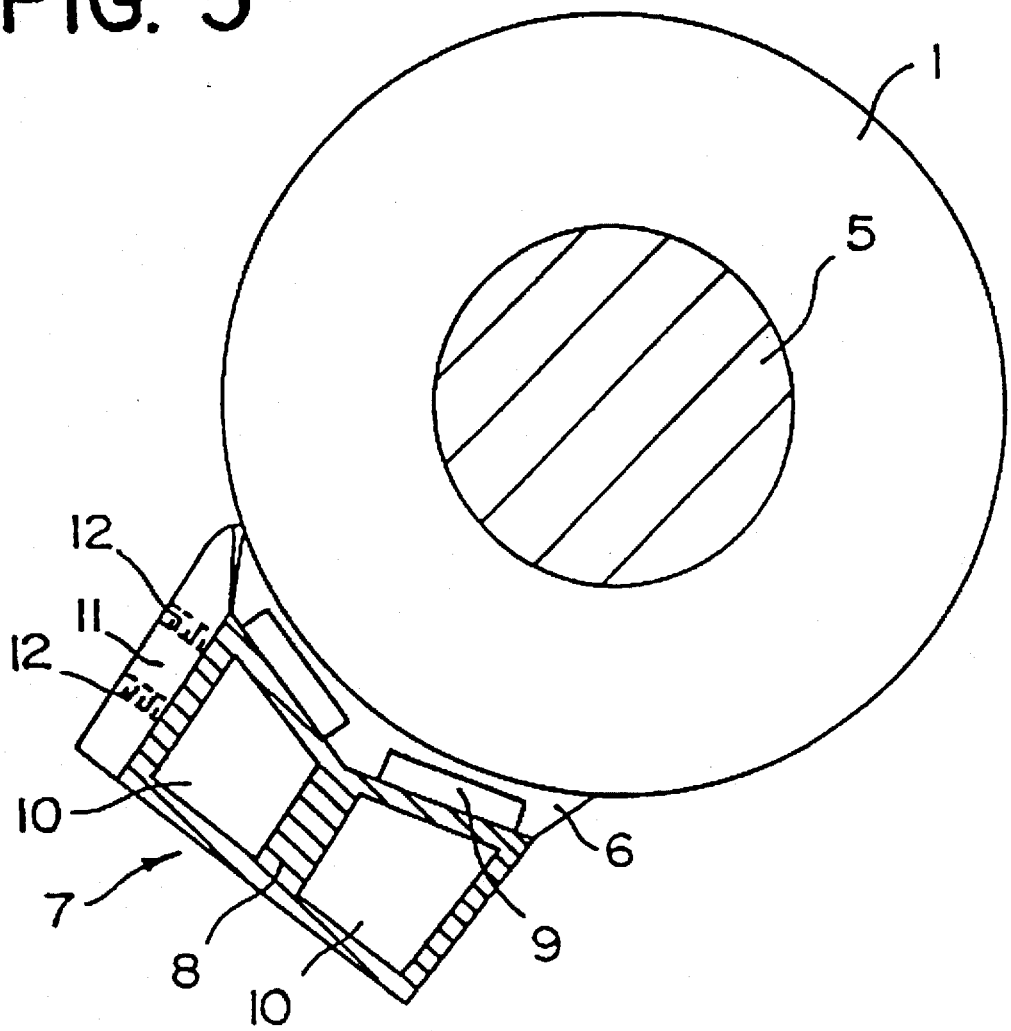
FIG. 5 is a sectional end view, similar to that of FIG. 2, but taken along line 5—5 of FIG. 1, showing the engaging surface of the combing element situated in precisely the same plane as the engaging surface of the carrier on the axle boxes.
Figure 6:
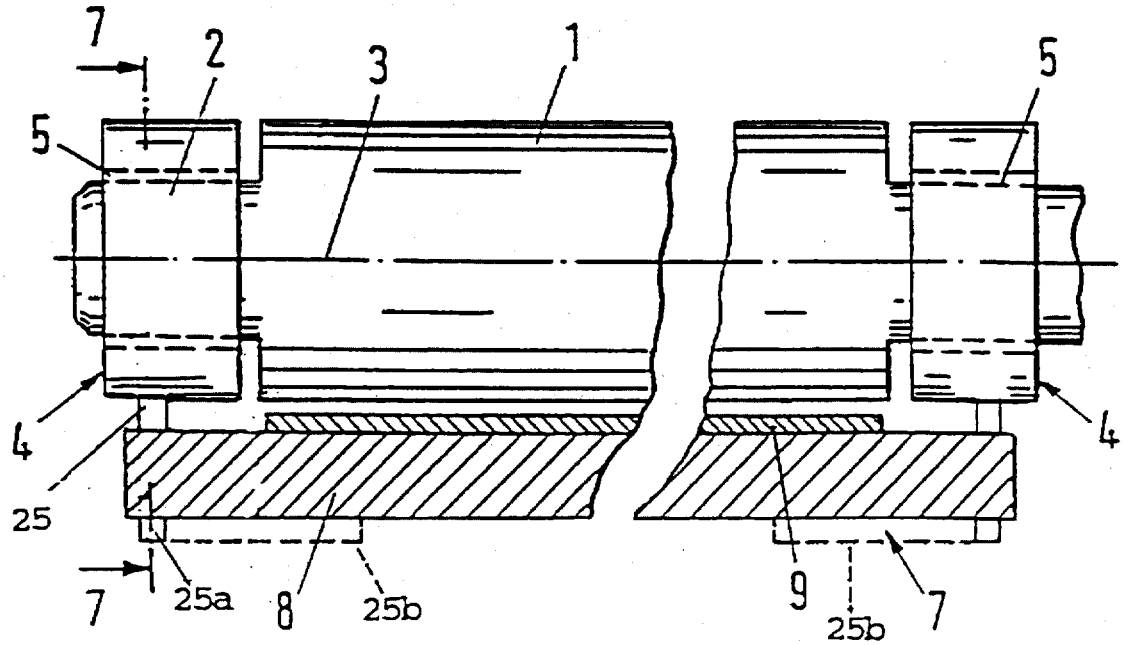
FIG. 6 is a schematic partial side view, similar to FIG. 1, of a roller including a cross section through a working element, showing a variation in the manner in which the working element is precisely positioned relative to the roller.

In FIG. 4, in which the end cap 6 is unitary with the carrier of the working element, arcuate engagement surface 23 of the end cap 6 is shown to be in abutment with engagement surface 24 of the roller retainer or axle box 4.

FIGS. 6–18 illustrate still further variations of the previously described embodiments, all of which share the aforementioned feature of precise positioning of the working element with respect to the roller by means of confronting abutment surfaces.

In the embodiment of FIGS. 6 and 7A–7C, the working element 7 is positioned with respect to the roller by means of a framework or support cradle 25 having portions extending from each of the roller retainers or axle boxes 4 and providing an underlying support portion 25*a* with surfaces for engagement with complementary surfaces of the carrier 8 of the working element 7 for properly positioning the working element in relation to the fiber roller. It is also contemplated that the support portions 25 could include longitudinally extending underlying portions 25*b*, shown in dotted lines in FIG. 6, to provide additional support for the carrier 8.

Figure 7A:
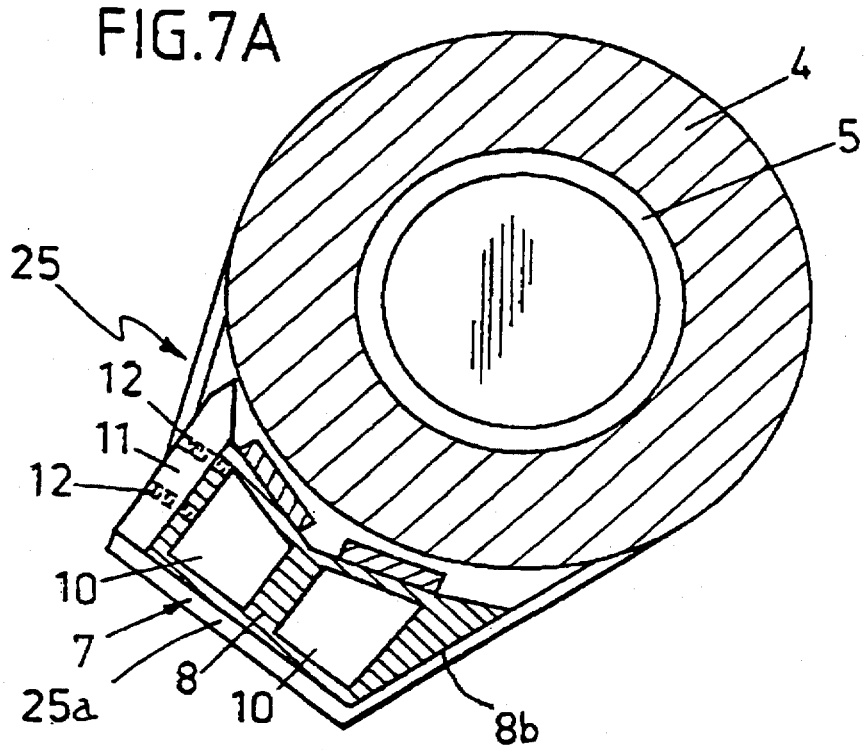
FIGS. 7A, 7B, and 7C are sectional end views, each similar to that of FIG. 2, taken along line 7—7 Of FIG. 6, each of FIGS. 7A, 7B, and 7C illustrating different variations.

More specifically, in FIG. 7A, the underlying support portion 25*a* of the support cradle 25 has an inner surface that engages with a confronting surface 8*a* of the carrier 8 for defining the radial positioning of the working element and a side of the support cradle 25 has an inner surface that engages with a respective confronting surface 8*b* of the carrier 8 for defining the angular positioning of the working element. It is contemplated that a fixing screw or other means is to be used for holding the carrier in position in the support cradle. Although not shown, on the side of the carrier opposite of surface 8*b* there can be provided, if desired, another surface for engaging a respective further surface of the support cradle, for additional angular positioning of the working element.

Figure 7B:
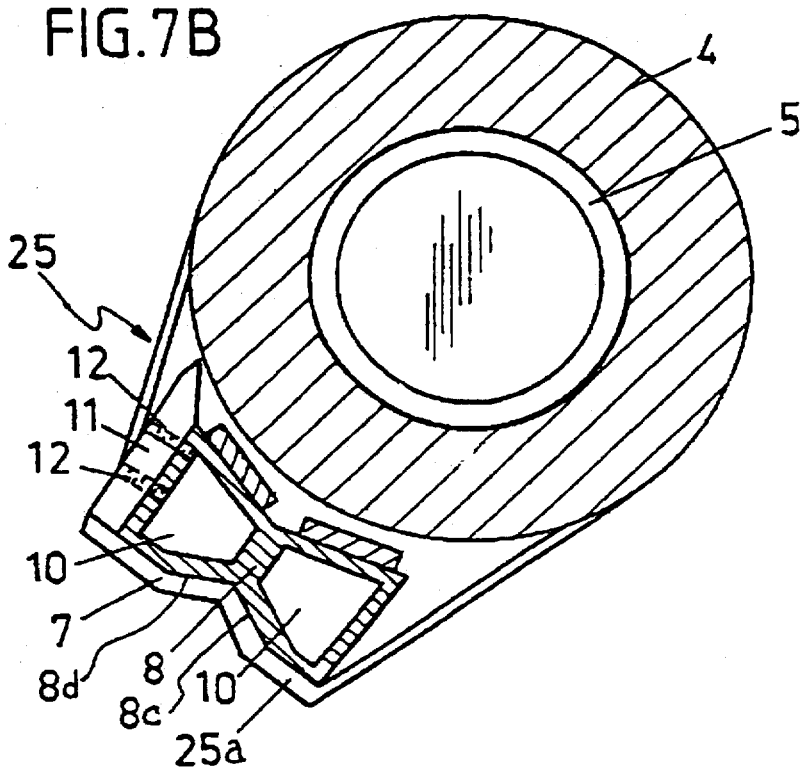

An alternative is illustrated in FIG. 7B, whereby the respective engagement surfaces between the carrier 8 and the cradle 25 are provided by means of so-called prismatic surfaces, as described in connection with FIGS. 1 and 2, above. As shown, the carrier 8 includes confronting surfaces 8*c*, 8*d* which engage respective surfaces of the support portion 25*a* to define the radial and angular positioning of the working element. It is contemplated that a fixing screw could be inserted from below to secure the position of the working element.

Figure 7C:
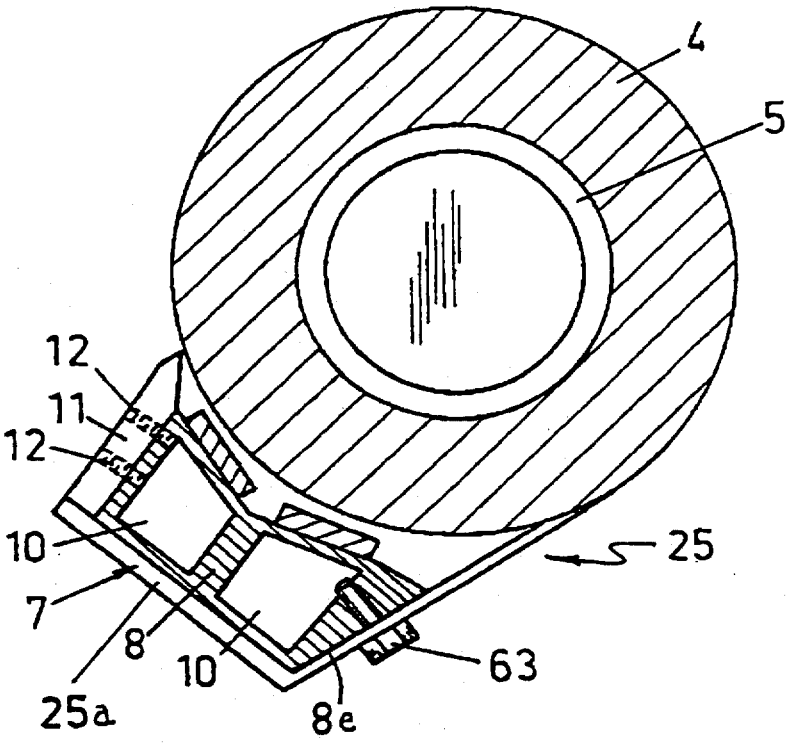

Another alternative is illustrated in FIG. 7C, in which a one-sided cradle 25 is provided. On the side of the cradle thus provided, a side of the support cradle 25 has an inner surface that engages with a respective confronting surface Be, like surface 8b of FIG. 7A, of the carrier 8 for defining the angular positioning of the working element. As with FIG. 7A, the underlying support portion 25a of the support cradle 25 has an inner surface that engages with a confronting surface of the carrier 8 for defining the radial positioning of the working element. FIG. 7C also shows a fixing screw 63 for fixing the carrier in the support cradle.

Figure 8:
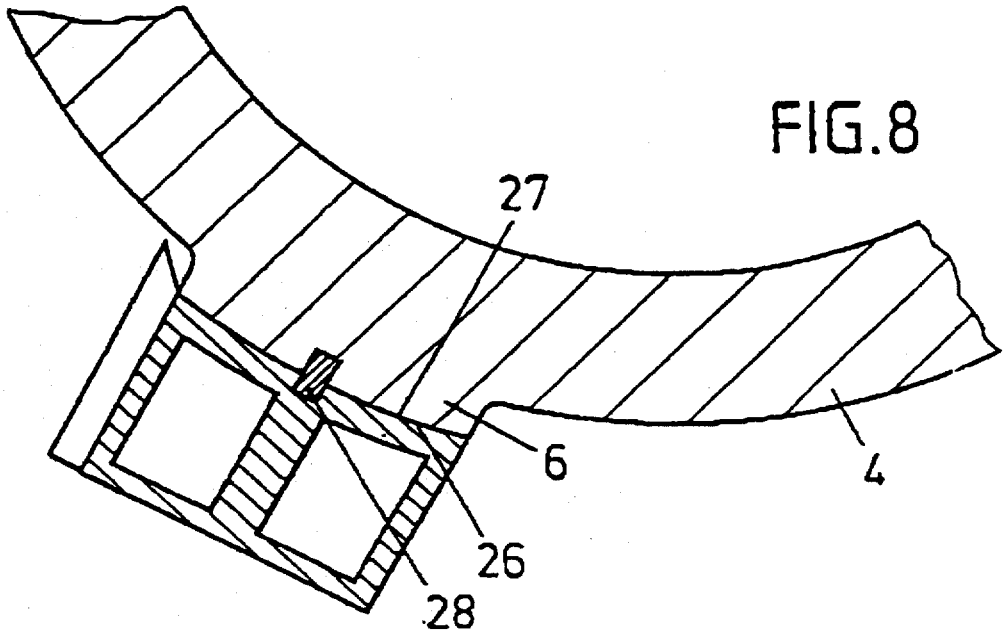
FIG. 8 is a sectional end view, similar to that of FIG. 2, showing a variation in which abutting surfaces between the roller retainer and the working element are engaged for precise positioning of the working element.

The sectional end view of FIG. 8 shows a variation in which the axle box 4 is shown to have an end cap 6 having an externally facing arcuate surface, which may or may not have the same radius of curvature of other external surfaces of the axle box and/or fiber roller, which comprises an engagement surface 26 fixed in abutment with an engagement surface 27 of the carrier of the working element. Further, to provide a secure peripheral positioning or centering of the working element, a centering bore extends within the mating engagement surfaces 26, 27 and that a pin, wedge, flat profile element 28, or other type of member could extend within each of the bores to ensure the precise centering positioning of the working element.

Figure 9:
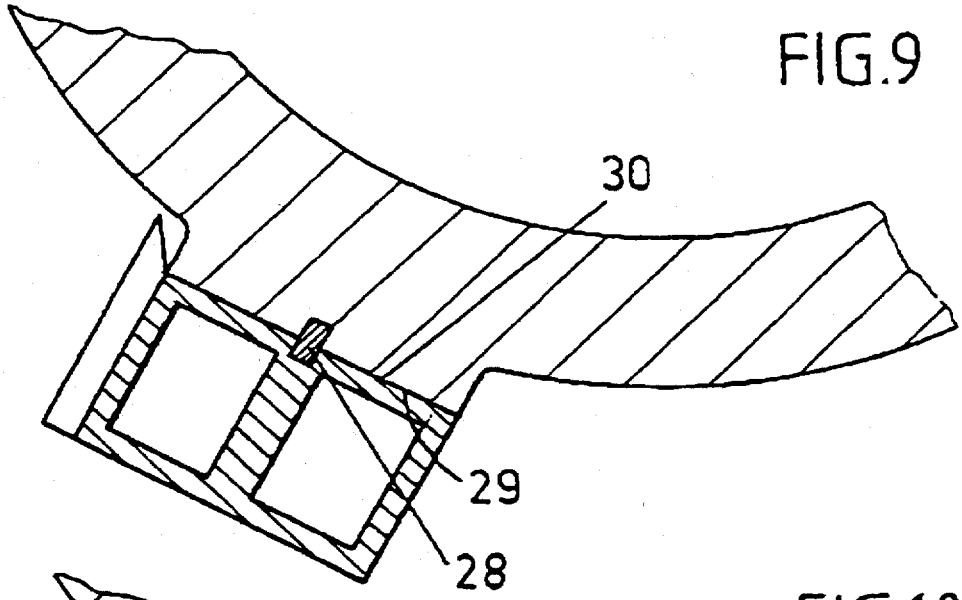
FIG. 9 illustrates a variation of the arrangement of FIG. 8.

FIG. 9 is similar to FIG. 8, but shows that the mating abutment engagement surfaces 29, 30 could be planar, again with a centering pin 28 or other equivalent element extending within centering bores as in the embodiment of FIG. 8.

Figure 10:
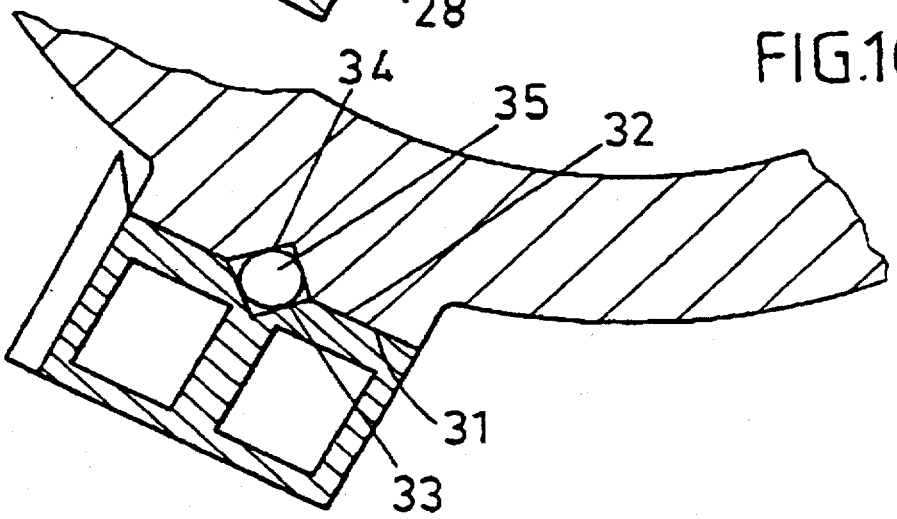
FIG. 10 illustrates another variation of the arrangement of FIG. 8.

FIG. 10 illustrates a variation on the centering bore/pin arrangements of FIGS. 8 and 9. More particularly, whereby the mating abutment surfaces 31, 32 could be complementarily shaped (like that of FIG. 8 or FIG. 9, for example), the centering bores of FIGS. 8 and 9 are replaced with respective facing prismatically shaped surfaces 33, 34. Recessed surfaces 33, 34 cooperate to form a housing within which a longitudinally extending cylindrical rod is positioned therein for precise centering of the working element with respect to the fiber roller.

In the embodiments of FIGS. 8, 9, and 10, an additional element (i.e., a pin or roller, e.g.) is utilized for ensuring a precise angular setting for the working element. It is to be understood that FIGS. 8–10 illustrate various ways in which mating surfaces are positioned, in these embodiments with the added feature of a centering pin, roller or other equivalent element. However, means such as adhesive, weldments, a fixing screw, etc. are relied upon to secure the mating surfaces together.

Figure 11:
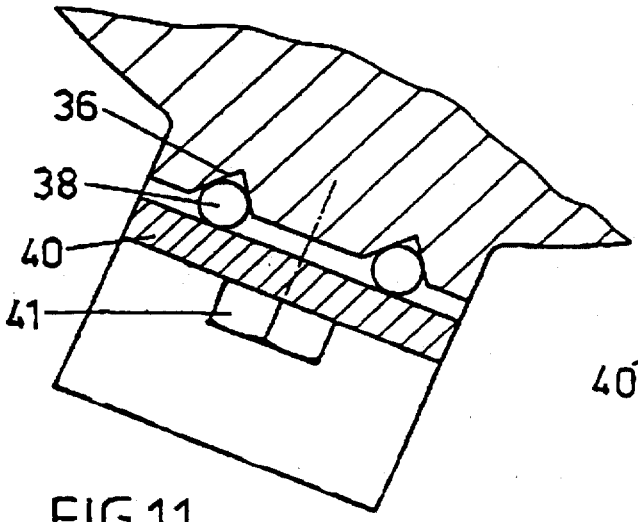
FIG. 11 is a sectional end view of a still further embodiment of the invention showing the connection between the end cap and the working element.
Figure 12:
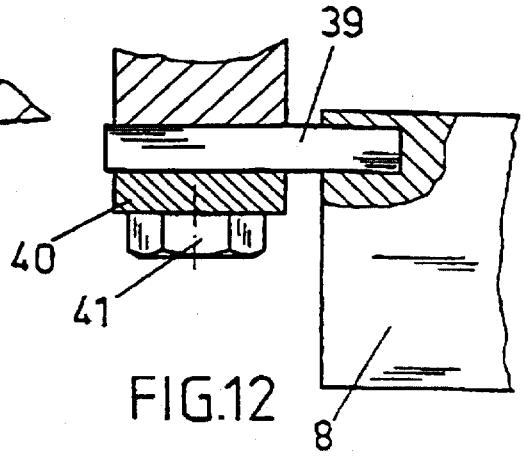
FIG. 12 is a sectional partial side view of the embodiment of FIG. 11.

FIGS. 11 and 12 illustrate an embodiment of the invention whereby the axle boxes or roller retainers 4 straddle between them the carrier 8 of the working element 7, i.e., the end caps or extensions 6 of the axle boxes are positioned laterally of the carrier 8. As can be seen in FIG. 11, the end caps include prismatically shaped recessed surfaces 36, 37 which are formed therein and which receive respective dowels 38, 39. The dowels 38, 39 are in turn frictionally fit, or otherwise secured, within the carrier 8, as shown in FIG. 12.

To clamp the dowels 38, 39 against the underside of the end caps, and thereby to secure the precise orientation of the working element with respect to the opening roller in the embodiment of FIGS. 11, 12, i.e., for precise radial positioning and peripheral positioning, as mentioned above, a pressing plate 40 is affixed to the end caps 6 by means of threaded bolts 41, or other equivalent fastening means, thereby enabling the application of pressure against the pressing plate to ensure that the dowels 38, 39 are pushed firmly into the respective spaces defined by the surfaces 36, 37. In this way, the periphery of each dowel 39 and the portions of the surfaces 37 that engage the periphery of respective dowels 39 constitute abutting engagement surfaces for the precise positioning of the working element in relation to the fiber roller.

Figure 13:
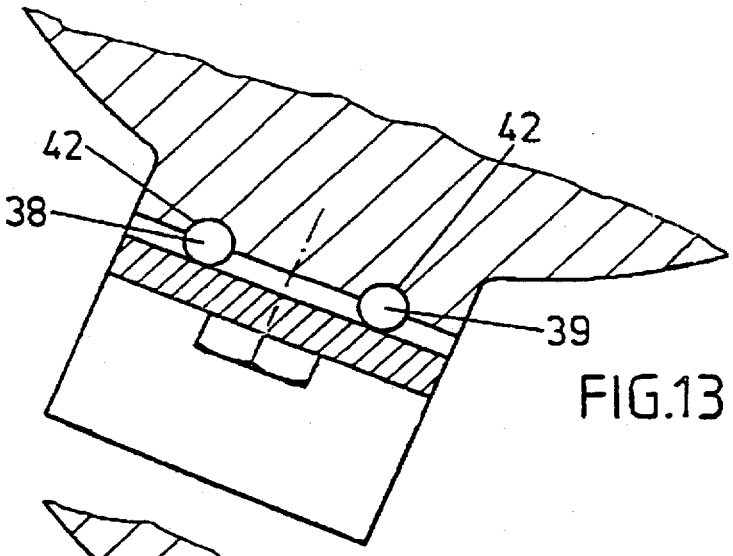
FIG. 13 illustrates a variation of the arrangement of FIG. 11.

It is contemplated that, instead of prismatic surfaces, the end caps could have formed therein concave arcuate recesses 42, as shown in FIG. 13, having perhaps half round internal surfaces, within which the dowels could be received. As with the aforementioned prismatic surfaces, the arcuate recesses serve both functions of distance positioning and peripheral positioning of the working element 7 with respect to the roller 1.

Figure 14:
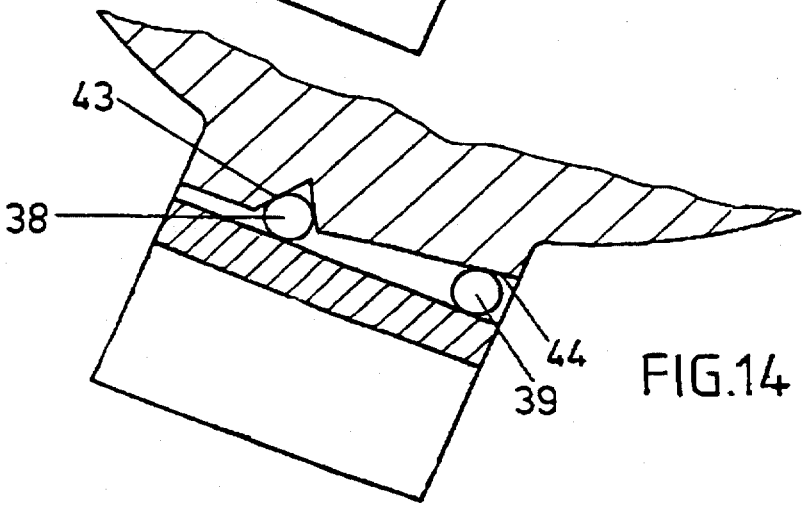
FIG. 14 illustrates another variation of the arrangement of FIG. 11.

It is also contemplated that one could utilize at least one positioning recess 43, prismatic or arcuate in shape, for example, and at least one planar surface 44, as shown in FIG. 14, whereby the prismatic surface shape, upon receiving a dowel 38, would provide angular positioning and distance positioning and the planar surface would provide only distance positioning with, e.g., a second dowel 39 would be interposed between the end cap and the working element.

Figure 15:
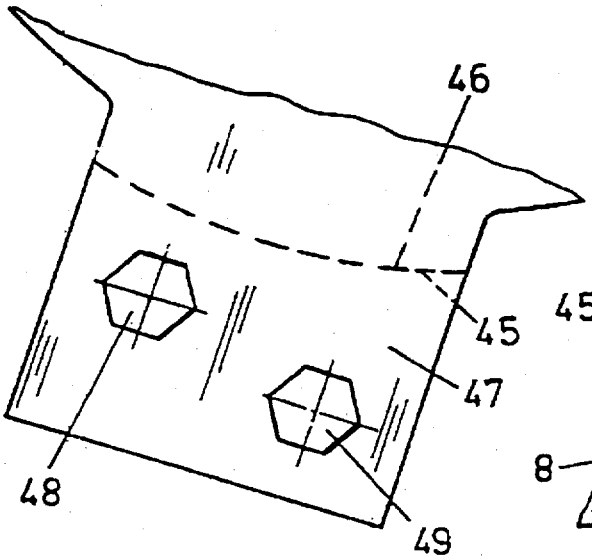
FIG. 15 is a sectional end view of a still further embodiment of the invention showing the connection between the end cap and the working element.
Figure 16:
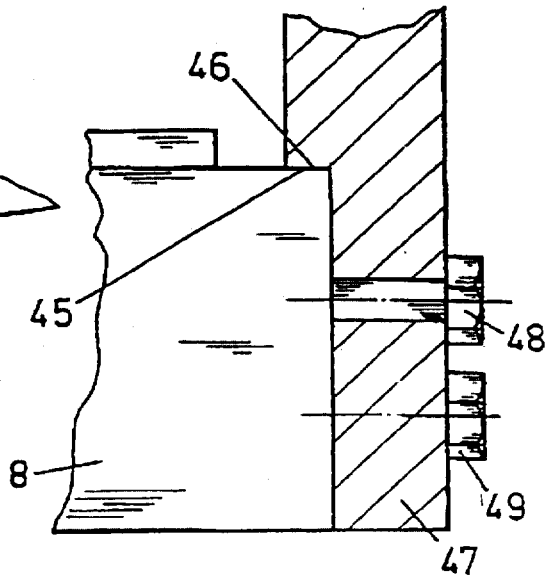
FIG. 16 is a sectional partial side view of the embodiment of FIG. 15.

FIGS. 15 and 16 illustrate yet another embodiment of the invention, whereby mating abutment surfaces 45 and 46 of the end caps 6 and the carrier 8 of the working element can be either prismatic, planar, arcuate or other shapes and whereby the end caps include extensions 47 on either longitudinal end of the working element which are secured to the carrier 8 of the working element by means of bolts 48, 49 or other fastening means. In this embodiment, the surfaces 45, 46 provide the distance positioning and the bolts 48, 49 provide the peripheral positioning.

Figure 17:
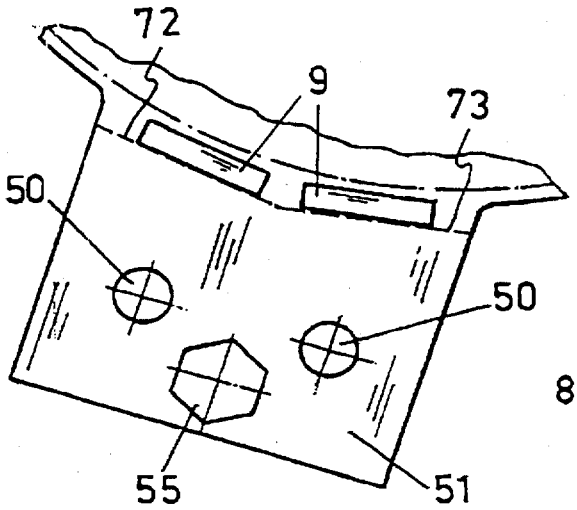
FIG. 17 is a sectional end view of a still further embodiment of the invention showing the connection between the end cap and the working element.
Figure 18:
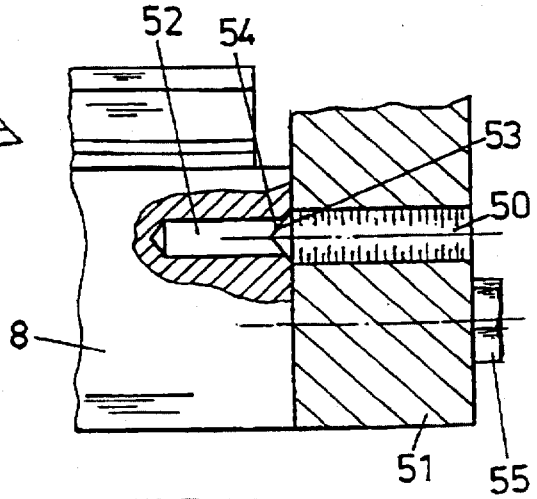
FIG. 18 is a sectional partial side view of the embodiment of FIG. 17.
Figure 19:
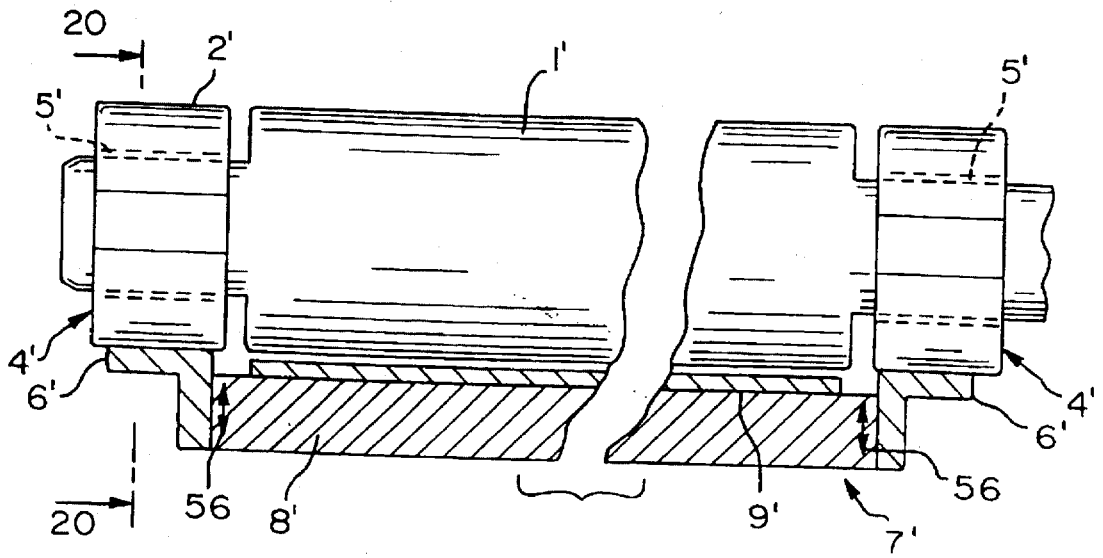
FIG. 19 PRIOR ART
FIG. 19 is a schematic partial view of a fiber-opening roller according to the prior art.

On the other hand, in the embodiment of FIGS. 17 and 18 at least one threaded bolt 50 extends through a respective extension 51 of each end cap 6 and the threaded bolt provides the functions of both distance positioning and peripheral positioning. More specifically, within an end surface of the carrier 8 of the working element there is at least one bore 52 within which a tapered end of a respective threaded bolt 50 projects for precisely positioning the working element for both distance and centering. The end of the bore 52 widens near the end surface of the carrier 8 to form an engagement surface 53 and the tapered end of the bolt 50 includes an abutting engagement surface 54. Thereby, inclined abutting engagement surfaces 53, 54 provide the distance and centering positioning functions of the working element.

Further in this embodiment, it is contemplated that one or more retention fasteners 55 can also extend through the cap extension 51 and into the carrier 8 for securing the carrier in place.

In the opposite end surface of the carrier 8, it is possible that merely a single bolt 50 and corresponding bore 52 can be provided, for distance positioning, together with one or more retention fasteners 55 (such as a screw, bolt, adhesive, for example). In such a case, peripheral positioning would be adequately accomplished by the two bolts 50 at the end shown in FIGS. 17 and 18.

Still further, as shown in FIG. 17, the carrier 8 can be provided with flat, i.e., planar, surfaces 72, 73 to receive conventional carding bars 9. The carriers 8 indicated in the other figures can also be provided with such flat support surfaces, preferably parallel to respective planes each disposed at a tangent to the envelope of the licker-in. The support surfaces can be flat even in those cases in which the "engaging surfaces" are curved.

Figure 20:
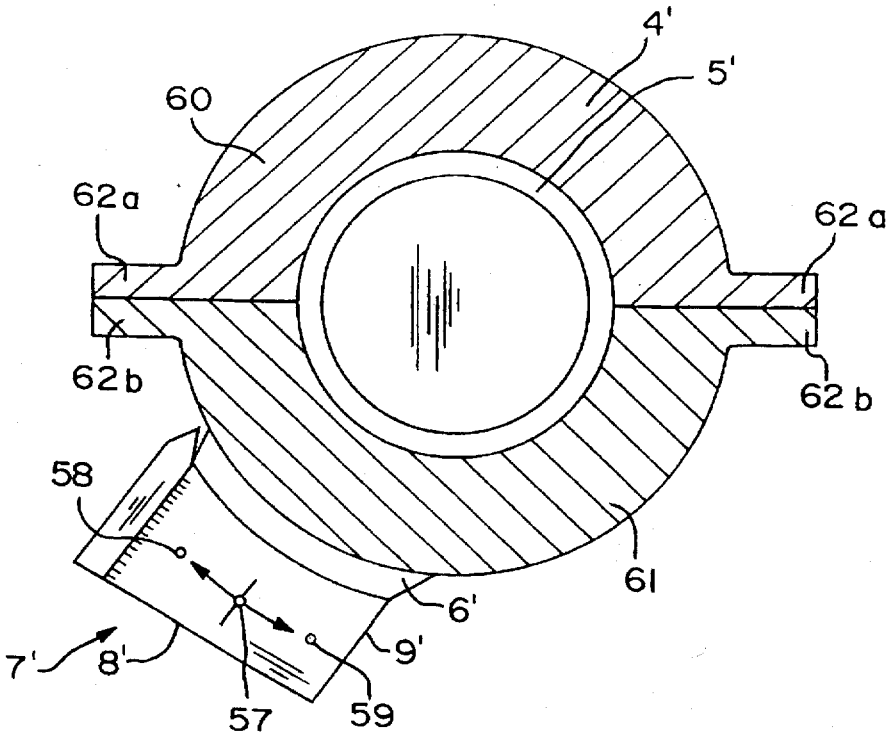
FIG. 20 PRIOR ART
FIG. 20 is a sectional view, taken along line 20—20 of the prior art illustration of FIG. 19.
Figure 21:
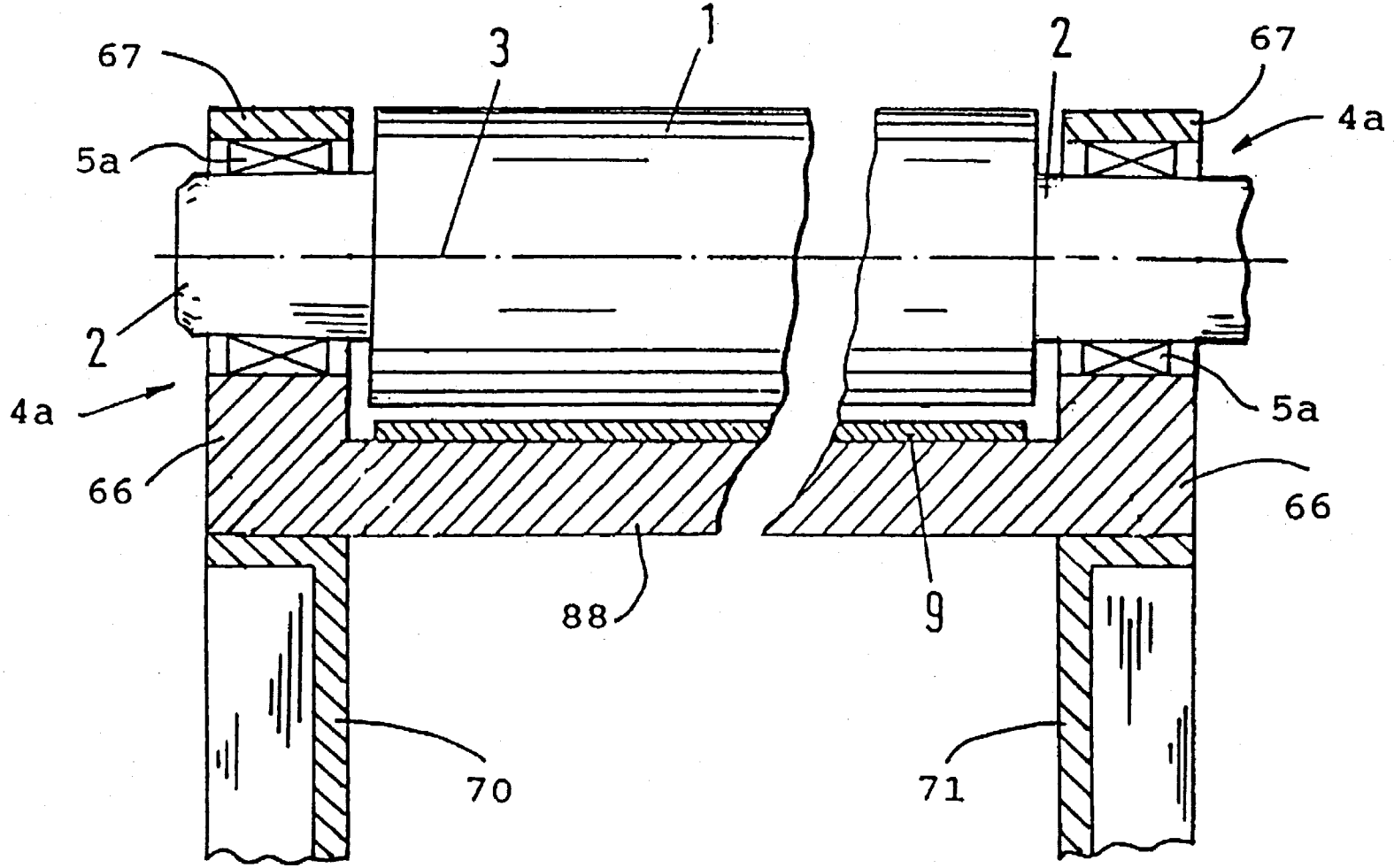
FIG. 21 illustrates, in partial sectional view, yet a further arrangement.

Finally, in the embodiment of FIG. 21 the carrier portion 88 of the working element are shown to be made unitarily, i.e., in one piece, with the lower sections 66 of the axle boxes 4a. In this connection, the lower sections 66 are similar to the lower section 61 of FIG. 20, i.e., in the sense that the lower sections 66 are separable from upper sections 67. The roller 1 can be assembled with the axle boxes by first removing the upper sections of the axle boxes and then replacing them after the roller shaft has been seated in its bearings. The bearings 5a for supporting the axle of the roller 1 are shown schematically in FIG. 21. FIG. 21 also illustrates side frame members 70, 71 of the fiber machine, such as a carding machine, which support the axle boxes.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. An apparatus comprising:

a fiber-opening roller extending along a longitudinal axis, said roller having an exterior periphery;

a plurality of roller retainers for supporting said roller at spaced locations for rotation around said longitudinal axis of said roller;

a working element;

a positioning arrangement for setting said working element at a predeterminate position with respect to said roller;

said positioning arrangement comprising a plurality of spacers for positioning said working element a predeterminate distance from said exterior periphery of said roller; and said plurality of spacers being longitudinally spaced apart and each of said spacers being located between a respective roller retainer and a respective portion of said working element for ensuring precise radial and pivotal orientation of said working element relative to said fiber-opening roller.

2. An apparatus according to claim 1, wherein:

each of said spacers is unitary with a respective one of said roller retainers.

3. An apparatus according to claim 1, wherein:

each of said spacers is unitary with said working element.

4. An apparatus according to claim 2, wherein:

each of said spacers comprises a surface in abutting engagement with a surface of said respective portion of said working element.

5. An apparatus according to claim 4, wherein:

each of said surfaces of said spacers in abutting engagement with said surfaces of said working element is planar.

6. An apparatus according to claim 4, wherein:

each of said surfaces of said spacers in abutting engagement with said surfaces of said working element is arcuate.

7. An apparatus according to claim 4, wherein:

each of said spacers comprises at least partially prismatically shaped surfaces in abutting engagement with surfaces of said respective portion of said working element.

8. An apparatus according to claim 3, wherein:

each of said spacers comprises a surface in abutting engagement with a surface of said respective roller retainer.

9. An apparatus according to claim 8, wherein:

each of said surfaces of said spacers in abutting engagement with said surfaces of said roller retainer is planar.

10. An apparatus according to claim 8, wherein:

each of said surfaces of said spacers in abutting engagement with said surfaces of said roller retainer is arcuate.

11. An apparatus according to claim 8, wherein:

each of said spacers comprises at least partially prismatically shaped surfaces in abutting engagement with surfaces of said surfaces of said roller retainer.

12. An apparatus according to claim 1, wherein:

each of said spacers is a part separate from said roller retainers and said working element and each of said spacers comprises at least a first surface in abutting engagement with a surface of said respective portion of said working element and a second surface in abutting engagement with a surface of said respective roller retainer.

13. An apparatus according to claim 12, wherein:

at least said first abutting engagement surfaces of said spacers are planar.

14. An apparatus according to claim 12, wherein:

at least said first abutting engagement surfaces of said spacers are arcuate.

15. An apparatus according to claim 14, wherein:

each of said spacers comprises at least partially prismatically shaped surfaces, said first abutting engagement surfaces of said spacers being one of said partially prismatically shaped surfaces in abutting engagement with surfaces of said respective portion of said working element.

16. An apparatus according to claim 1, wherein:

said positioning arrangement comprises no means for radial adjustment of said working element with respect to said roller and no means for pivotal adjustment of said working element with respect to said roller.

17. An apparatus comprising:

a fiber-opening roller extending along a longitudinal axis, said roller having an exterior periphery;

a plurality of roller retainers for supporting said roller at spaced locations for rotation around said longitudinal axis of said roller and at least one abutting engagement surface of each of said roller retainers fixed with respect to each respective roller retainer;

a working element and at least one abutting engagement surface of said working element fixed with respect to said working element;

a positioning arrangement for setting said working element at a predeterminate fixed position with respect to said roller against radial and pivotal adjustability of said working element with respect to said roller, by affixation of a first engagement surface with a second engagement surface, said first engagement surface comprising either one of said abutting engagement surfaces of said working element or said abutting engagement surface of a respective roller retainer and said second engagement surface comprising an abutting engagement surface fixed with respect to the other of said working element and a respective roller retainer.

18. An apparatus according to claim 17, wherein:

said first engagement surface comprises one of said abutting engagement surfaces of said working element and said second engagement surface comprises said abutting engagement surface of a respective roller retainer.

19. An apparatus according to claim 17, wherein:

said roller retainer comprises a unitary spacer extension; and said first engagement surface comprises a surface of said spacer extension and said second engagement surface comprises one of said abutting engagement surfaces of said working element.

20. An apparatus according to claim 17, wherein:

said working element comprises a unitary spacer extension; and said first engagement surface comprises a surface of said spacer extension and said second engagement surface comprises said abutting engagement surface of a respective roller retainer.

21. An apparatus according to claim 17, wherein:

said positioning arrangement further comprises:

at least one spacer, each of said spacers being a part separate from said roller retainers and said working element;

a third engagement surface in engagement with a fourth engagement surface;

said first engagement surface comprises said abutting engagement surface of a respective roller retainer;

said second engagement surface comprises an abutting engagement surface of said spacer;

said third engagement surface comprises a further abutting engagement surface of said spacer; and said fourth engagement surface comprises one of said abutting engagement surfaces of said working element.

22. An apparatus according to claim 17, wherein:

said positioning arrangement comprises at least one centering element extending within each of said first and second engagement surfaces.

23. An apparatus according to claim 22, wherein:

each of said first and second engagement surfaces is planar and constitutes means for providing precise distance positioning of said working element; and said centering element constitutes means for providing precise centering positioning of said working element.

24. An apparatus according to claim 22, wherein:

each of said first and second engagement surfaces is arcuate and constitutes means for providing precise distance positioning of said working element; and said centering element constitutes means for providing precise centering positioning of said working element.

25. An apparatus according to claim 17, wherein:

each of said first and second engagement surfaces comprises a first surface portion that is planar or arcuate and a second surface portion that is recessed from said first surface portion and is prismatically shaped, said first surface portion constituting means for providing precise distance positioning of said working element;

said second surface portion of each of said first and second engagement surfaces cooperate to form a centering housing;

said positioning arrangement further comprises a centering element, said centering element being engaged within said centering housing; and said centering element and said centering housing constitute means for providing precise centering positioning of said working element.

26. An apparatus according to claim 17, wherein:

said positioning arrangement further comprises a member extending from a respective one of said roller retainers, said extending member being positioned at a longitudinal end of said working element;

said first engagement surface comprises an abutting engagement surface of said working element; and said second engagement surface comprises an abutting engagement surface of said extending member.

27. An apparatus according to claim 26, wherein:

said abutting engagement surface of said extending member is a surface of a recessed portion of said extending member within which a portion of said working element is received.

28. An apparatus according to claim 17, wherein:

said first engagement surface comprises an abutting engagement surface of a respective roller retainer, said abutting engagement surface of said respective roller retainer comprising a recessed surface;

said positioning arrangement further comprises at least one positioning element fixed with respect to said working element, said positioning element comprising an outer periphery constituting said second engagement surface; and means for securing said first engagement surface to said second engagement surface for setting said working element at a predeterminate fixed position with respect to said roller against radial and pivotal adjustability of said working element with respect to said roller.

29. An apparatus according to claim 28, wherein:

said recessed surface of said respective roller retainer comprises a prismatically shaped surface; and said positioning element comprises a cylindrical rod, said cylindrical rod having a peripheral surface constituting said second engagement surface for engaging said prismatically shaped surface.

30. An apparatus according to claim 28, wherein:

said recessed surface of said respective roller retainer comprises a concave surface; and said positioning element comprises a cylindrical rod, said cylindrical rod having a peripheral surface constituting said second engagement surface for engaging said concave surface.

31. An apparatus according to claim 17, wherein:

said positioning arrangement comprises a framework for supporting said working element, said framework being fixed with respect to a respective roller retainer;

said first engagement surface is an abutting engagement surface of said framework; and said second engagement surface is an abutting engagement surface of said working element.

* * * * *